United States Patent [19]

Pritchett

[11] Patent Number: 4,991,236

[45] Date of Patent: Feb. 12, 1991

[54] HAT RETAINING DEVICE

[76] Inventor: Steven W. Pritchett, 12117 Eddys Park Dr., Herndon, Va. 22070

[21] Appl. No.: 431,239

[22] Filed: Nov. 3, 1989

[51] Int. Cl.[5] ..... A42B 7/00

[52] U.S. Cl. ..... 2/189; 2/185 R; 2/199; 132/57.1

[58] Field of Search ..... 2/185 R, 199, 189, 188, 2/421, 177; 132/59, 58, 57.1

[56] References Cited

U.S. PATENT DOCUMENTS

| | | | |
|---|---|---|---|
| 701,639 | 6/1902 | Stamm | 2/185 R |
| 736,692 | 8/1903 | Condren . | |
| 815,714 | 3/1906 | Keator . | |
| 846,953 | 3/1907 | Rosenthal . | |
| 867,814 | 10/1907 | Fornander . | |
| 903,037 | 11/1908 | Westlund . | |
| 921,856 | 5/1909 | Loubrie | 2/189 |
| 942,678 | 12/1909 | Soden . | |
| 1,021,647 | 3/1912 | Waterworth . | |
| 1,124,385 | 1/1915 | Ball | 132/59 |
| 1,419,325 | 6/1922 | Storm | 132/58 |
| 1,831,776 | 11/1931 | Nelson . | |
| 2,846,683 | 8/1958 | Dye et al. | 2/421 |
| 2,904,052 | 9/1959 | Geiger | 2/185 R |
| 3,315,275 | 4/1967 | Erbb | 2/177 |

FOREIGN PATENT DOCUMENTS

| | | | |
|---|---|---|---|
| 331205 | 4/1903 | France | 2/185 R |
| 525560 | 5/1955 | Italy | 2/177 |

*Primary Examiner*—Thomas B. Will

*Attorney, Agent, or Firm*—Kerkam, Stowell, Kondracki & Clarke

[57] ABSTRACT

A hat retaining device is provided having a first head loop and a hat holding member for connecting a hat to be worn to the first head loop. The first head loop is of a size sufficient to be slipped over a wearer's head, and the hat holding member is adapted to attach to the hat and permit the head loop to rest comfortably and loosely around the wearer's neck at a base thereof when the hat is positioned on the wearer's head. The hat holding member is designed to keep the hat in close proximity to the wearer's body when the hat is inadvertently or deliberately removed.

24 Claims, 2 Drawing Sheets

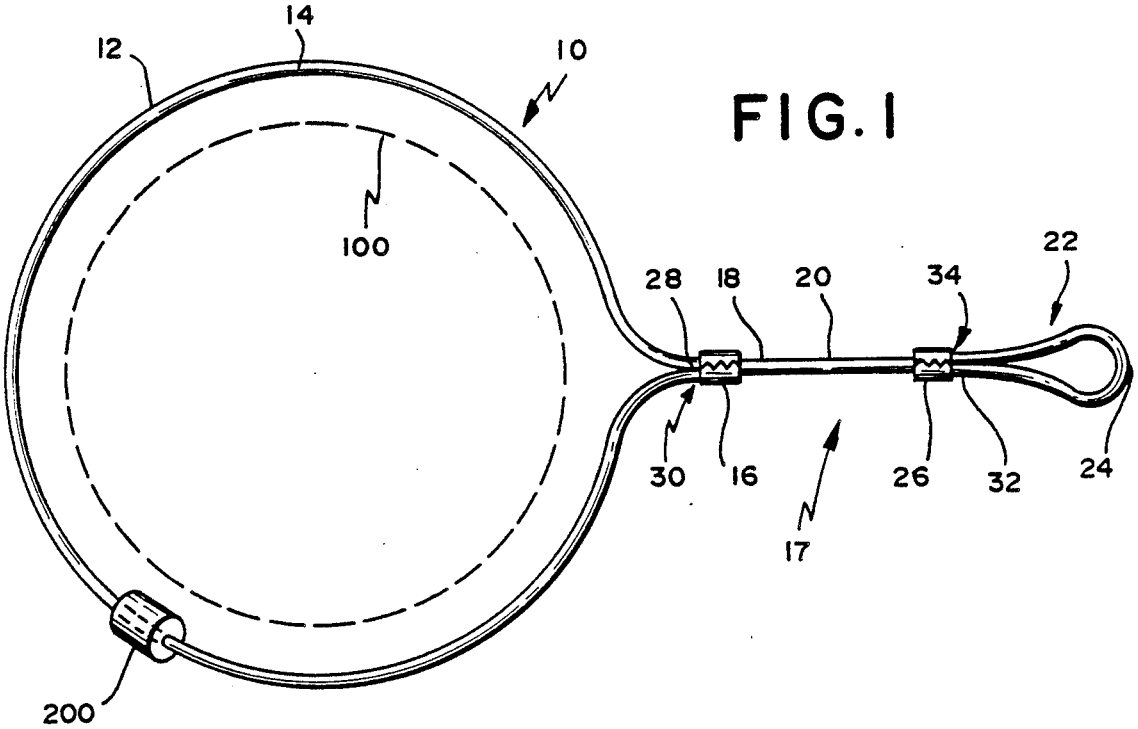
FIG. 1
FIG. 2
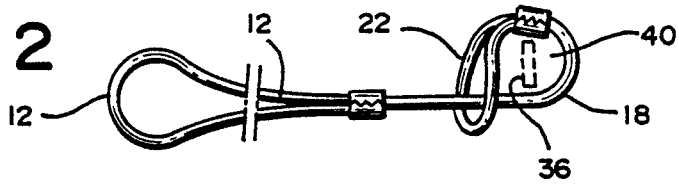
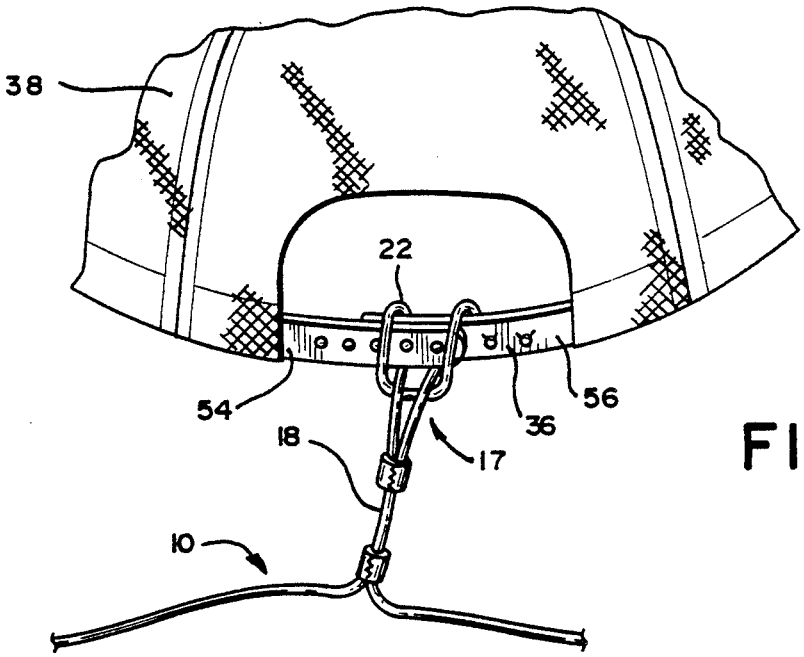
FIG. 3

HAT RETAINING DEVICE

BACKGROUND OF THE INVENTION

1. Field of the Invention

The present invention relates to a device to be used in retaining a hat close to a wearer's body. The device prevents a hat from being blown off or otherwise being removed unintentionally from the wearer's head.

2. Description of Related Art

Heretofore, numerous devices have been proposed in the art for preventing a hat worn by a person from blowing off completely free of the wearer, requiring the wearer to retrieve the hat in a distant location. Examples of such devices are shown in the following United States Patents: U.S. Pat. No. 846,953; U.S. Pat. No. 1,831,776; U.S. Pat. No. 736,692; U.S. Pat. No. 815,714; U.S. Pat. No. 867,814; U.S. Pat. No. 942,678; U.S. Pat. No. 1,021,647; U.S. Pat. No. 903,037. A modern variant on the hat guard disclosed in U.S. Pat. No. 867,814, is currently being marketed, the primary improvement being that the length of the cord between the clips is made adjustable through the use of a clamp at the midpoint of the length of cord, dividing the cord into two halves, the two halves having a slidable ring surrounding them which is used to let out or take in the length of the two halves, as desired, to increase or reduce, respectively, the length of cord between the two clips.

A major disadvantage of prior art devices is that all of these require not only that the retaining device be attached in some way to the hat, but also the various designs all require another portion of clothing worn on the person's body. Many people nowadays wear hats, primarily of the baseball cap or visor styles, while at the beach or sailing, for example, while going shirtless, or wearing clothing such as tank tops or swimwear which would make attaching a retaining device difficult, if not impossible to accomplish.

It is therefore an important object of the present invention to provide a hat retaining device that is convenient to use whether or not clothing is worn on the upper body, and may be used without the necessity to attach the retaining device to an article of clothing.

SUMMARY OF THE INVENTION

The above and other objects of the present invention are accomplished by providing a hat retaining device which comprises a first head loop made of cord material and a hat holding means which is coupled with the head loop. The head loop is sized to easily slip over the head of a wearer and to rest comfortably and loosely around the base of a wearer's neck. Several embodiments are provided for the hat holding means to make the device capable of being employed with several different types of hats which may be worn.

The hat holding means may comprise a clip, such as an alligator clip or suspenders-type clip, tethered to the first head loop by single length of the cord material. The clip would be used to grasp or clamp the hat at a desired location.

Alternatively, the hat holding means could be a second smaller hat loop tethered to the first head loop by a single length of the cord material. A variation on this would be to connect the smaller hat loop directly adjacent to the first, larger head loop, by way of a single clamp. These embodiments of the hat retaining device would be used to wrap around a band found on the back of hats and visors which are adjustable in size. By passing the smaller loop over the band and subsequently threading the first head loop through the second smaller hat loop, a band retaining loop is formed which will closely surround the band when the first head loop is pulled substantially completely through the second hat loop. The smaller loop can also be made of a weaker material than the larger head loop, in order to provide a "weak link" in the retaining device in the event that abnormal pulling forces are experienced on the device.

The present invention thus provides an inexpensive, easy to use, hat retaining device, which among other advantages, may be used whether or not the hat wearer is wearing clothing on the upper body.

BRIEF DESCRIPTION OF THE DRAWINGS

These and other features of the present invention and the attendant advantages will be readily apparent to those having ordinary skill in the art and the invention will be more easily understood from the following detailed description of the preferred embodiments of the present invention taken in conjunction with the accompanying drawings wherein like reference characters represent like parts throughout the several views.

FIG. 1 is a top plan view of the hat retaining device of the present invention;

FIG. 2 is a side view of the hat holding means according to one preferred embodiment of the present invention;

FIG. 3 is a partial perspective view depicting the hat holding means of FIG. 2 as used with an adjustable baseball-style cap;

DETAILED DESCRIPTION OF THE INVENTION

Figure 4:
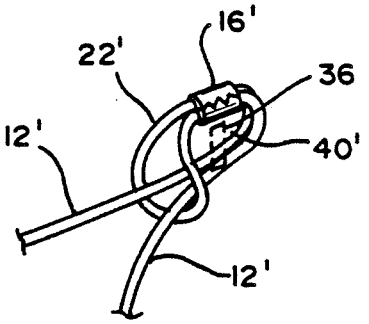
FIG. 4 is a side view of the hat holding means according to another preferred embodiment of the present invention.

Referring initially to FIG. 1, a preferred embodiment of a hat retaining device 10 according to the present invention is depicted. The hat retaining device 10 has a first head loop 12, formed of a single length of cord material 14 joined into a loop shape by first clamp means 16, which is preferably in the form of flat piece of aluminum or steel stamped or cut from an aluminum or steel sheet, the clamp means 16 being wrapped and crimped around two predetermined sections of cord material 14 to form the head loop.

First head loop 12 is preferably formed into a fixed size which is of sufficient size or diameter to fit comfortably over the head of the wearer, represented schematically by circular broken line 100. Generally speaking, it is preferred to make the first head loop as "one size fits all", for economy of manufacture, and as such, a size may be chosen such that the loop 12 will fit comfortably over all or nearly all adult heads. Alternatively the head loop can be manufactured in different sizes, or even made to be adjustable in size using a releasable clamp. However, when the device 10 is provided with an adjustable size head loop, the clamp means must be capable of locking the head loop at a fixed size when the device is in use.

Device 10 also comprises, in the FIG. 1 preferred embodiment, a hat holding means 17 which includes a tether 18 made up of a predetermined length of cord material 20, which may be made of the same material as head loop 12, the tether 18 being fixedly attached by first clamp means 16 to head loop 12. Hat holding means 17 also includes, attached at an opposite end of tether 18, a second hat loop 22, which also may be made of a cord material 24 identical to that of head loop 12 and tether 18. Second clamp means 26 is employed to retain hat loop 22 at the end of tether 18. Again, for economy of manufacture, second clamp means 26 is of a construction identical to that of first clamp means 16.

The hat retaining means 10 may be made from a single length of the desired cord material in an embodiment wherein the head loop 12, tether 18, and hat loop 22 are made of the same material. A first end 28 of the cord is clamped at first clamp means 16 with a first intermediate section 30 of the cord, the cord extending out of clamp means 16 to form tether 18. A second end 32 of the cord is looped back to a second predetermined intermediate section 34 of the cord, wherein second clamp means 26 holds the second end 32 and the section 34 together to form hat loop 22.

FIG. 1 shows an optional feature which may be provided on the device especially where the hat and device are worn near the water or on boats. A floatation means in the form of bobber 200 may be provided along the length of head loop 12. The bobber 200 will aid in maintaining the hat and hat retaining device near the surface of the water in the event that the hat becomes water logged and begins to sink before the owner has an opportunity to reclaim the hat. Other devices may be provided on the hat retaining device for performing specific functions related to an athletic endeavor or other activity.

FIGS. 2 and 3 illustrate a preferred approach to using the hat retaining device of FIG. 1 with an adjustable hat or with a visor, each of which has a relatively narrow band extending around at least a portion of the back of the head which is exposed, or not covered by, the hat or visor. It is to be recognized that the terms hat and visor are used interchangeably herein and the invention is not limited to use with a particular style of hat or visor, unless otherwise indicated. A representative band 36, typical of the band found on adjustable baseball-style hats, is shown in FIG. 3 attached to hat 38, and is also represented in broken lines in FIG. 2. In order to attach hat retaining device 10 to hat band 36, a portion of the device 10, preferably hat loop 22 is wrapped over the band. The large flexible head loop 12 is collapsed (FIG. 2) and threaded or passed through hat loop 22, thus forming band retaining loop 40. The entire head loop 12 and a portion of tether 18 are then preferably pulled through the hat loop 22, in order to bring band retaining loop 40 down to a size wherein band 36 is closely surrounded by and within loop 40.

After performing this operation, the wearer 102 (FIG. 6) would then slip head loop 12 over his or her head 104 and then position the hat 38 on the head. Should the hat 38 be subsequently blown off, knocked off, or deliberately taken off temporarily, the device 10 serves to retain the hat 38 close to the body 106 of the wearer. In the instances where the hat is accidentally blown off or knocked off, the device eliminates the need to chase after, reclaim from the water, and/or bend down to the ground to retrieve the hat. In the instances where the hat is deliberately removed, the device keeps the hat with the person while eliminating the need to hold the hat in the person's hand. The device further permits the removed hat to be conveniently held in front of the wearer's body or in back of the body 106, as desired.

FIG. 4 depicts a variation on the embodiment depicted and discussed with respect to FIGS. 1–3. The primary difference with this preferred embodiment, as compared to that of FIGS. 1–3, is that tether 18 and one of first or second clamp means 16, 26 is eliminated. A clamp means 16' is employed in this embodiment to connect hat loop 22' directly adjacent to head loop 12'. The device in this embodiment is used in essentially the same manner to retain band 36 as that described above with respect to FIGS. 1–3. Hat loop 22' is wrapped around band 36, and head loop 12' is subsequently threaded through hat loop 22' to surround and retain band 36 in a band retaining loop 40'. The device and hat are placed on the wearer's head in the same manner as that described above.

Figure 5:
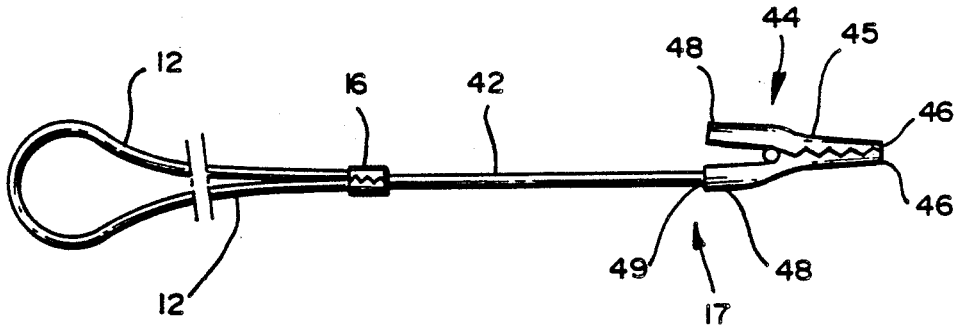
FIG. 5 is a side view of the hat holding means according to a further preferred embodiment of the present invention.

FIG. 5 depicts a further preferred embodiment of hat holding means 17, this embodiment being especially useful for coupling a hat or other head piece to head loop 12 of the hat retaining device when the hat has no exposed band about which a band retaining loop can be formed. In the FIG. 5 embodiment, head loop 12 is connected via first clamp means 16 to clip tether 42 which, as before, may be made of the same cord material as head loop 12. Clip tether 42 has, attached at its opposite end, a clip means 44 for grasping a desired portion of a hat therebetween. As depicted, clip means 44 comprises an alligator clip 45, having spring-biased clamping jaws 46 which can be separated by squeezing handles 48 together to receive the hat material therebetween. The spring bias returns the jaws 46 toward each other to grasp and retain the hat material. The clip means preferably has an integral second clamp means 49 at one of handles 48 for securing the clip means to clip tether 42. This clip means 44 may preferably be used to connect the device to a hat at either the bill 50 (FIG. 6) of a cap having such a bill, to a lower peripheral edge 52 of any type of hat, or to any other desired portion of the headware. The device is otherwise worn in the same manner as described above with respect to FIGS. 1–4.

It is to be recognized that clip means may comprise one of any of a number of paired clamping jaws, one other example being a suspender-type clip, as desired. The principal criteria for selecting an appropriate clip means 44 would be cost and ease of manufacture and, ultimately, ease of use.

Figure 6:
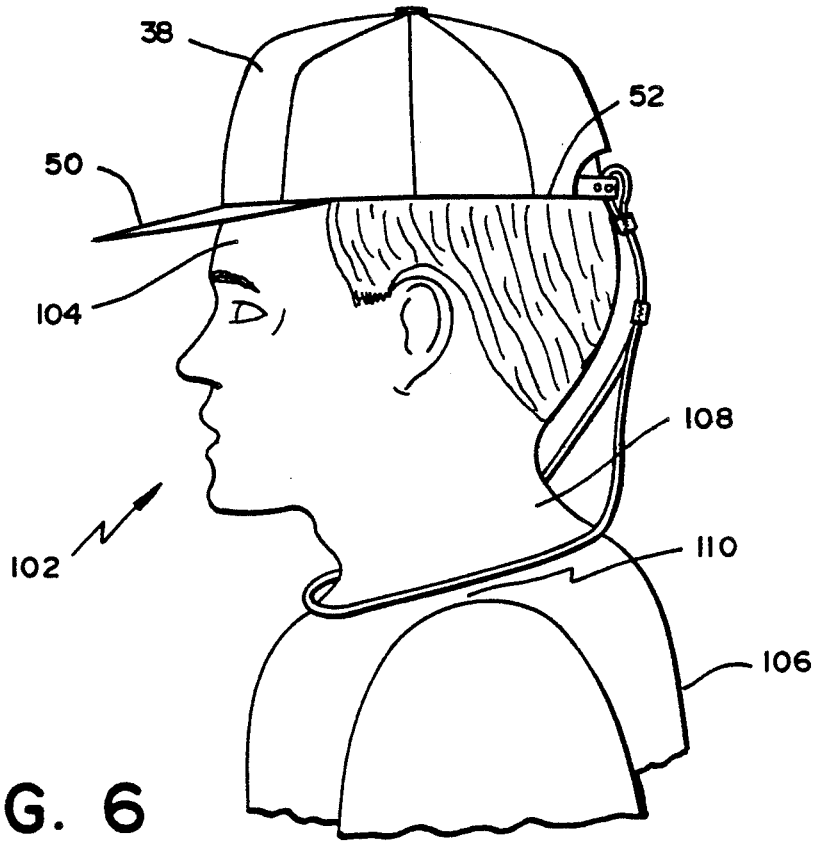
FIG. 6 is a side view of an upper body and head of a hat wearer, also depicting a hat worn on the head and the hat retaining device of the present invention as typically worn by the hat wearer.

FIG. 6 depicts the hat retaining device 10, as worn around the base of the neck 108 and shoulders 110 of a wearer, with the hat 38 positioned on the head 104. This figure depicts a further method for attaching device 10 to the type of adjustable hat which has an exposed band 36 made up of two separable tongue members 54, 56 (FIG. 3) extending across the back of the hat 38. The tongue members 54, 56 may be temporarily separated from one another and one or both of the tongue members are passed through hat loop 22, and are subsequently rejoined such that loop 22 alone is used as band retaining loop 40, the rejoined band extending through and being retained by loop 22.

As can be seen in this Figure, because head loop 12 is formed in a size sufficient to pass over the head 104 of the wearer, it will comfortably surround the smaller diameter neck 108 of the wearer, and will preferably primarily rest on the base of the neck or the collarbone and shoulder areas of the body. When the hat 38 is removed, head loop 12 retains the device 10 around the neck 108, and hat holding means 17 holds or retains the hat to which it is attached.

The hat retaining device 10 of the present invention can be supplied as a component of a headwear system, wherein the particular hat and hat retaining device are supplied as a unit. It is even possible, if desired, to permanently affix the hat holding means of the retaining device to the hat in situations where the retaining device will always be used with the hat. This may be accomplished by stitching a tether extending from the head loop, or the head loop itself, to a desired location on the hat.

A further preferred feature of the invention is to provide a means for releasing pulling forces at a preselected break point or weak link in the hat retaining device, in order to prevent the potential for causing discomfort or damage to the neck in the event that abnormal pulling forces on the device are encountered. One preferred approach to providing a weak link which may be used with any of the depicted embodiments is to make a preselected portion of the device of a cord material which is weaker in tension than the remainder of the device which will break at a desired tensile or pulling force. As an example, in the FIG. 4 embodiment, the hat loop 22' may be made of a weaker material, such as a polyester knit, than the head loop 12', which may be made of a polypropylene or nylon cord. In this embodiment, if the hat is pulled at a force which could cause discomfort or damage to the neck, the hat loop will break, thereby releasing the hat and the pulling forces applied to the hat. In the FIG. 2 and especially in the FIG. 5 embodiments, the tethers 18, 42, respectively, could be made of the material which is weaker in tension. It would also be possible to provide the weak link by making any of the above elements of the same cord material as the remainder of the device, but of a weaker gage, e.g. smaller diameter, than the remainder of the device.

While first and second clamp means 16, 26 are discussed as being preferably made from aluminum sheet stock, it will be readily apparent to those skilled in the art that numerous optional constructions may be employed to crimp or clamp the sections of cord together. In fact, depending on the type of cord material employed, the clamp means could even comprise a stitching used to retain the appropriate portions of the cord in fixed, side-by-side relation.

In a like manner, the cord material employed for making the hat retaining device may be selected from at least several options. A preferred material suitable for use is a product known as "polypropylene macro-may" which has some measure of elasticity, and can be provided in preferred widths of between 2–4 mm. Other elastic-type cords will also provide the generally desirable elastic features which are intended to reduce the amount of "jerk" which the wearer may feel when the hat is abruptly removed from the head. A braided nylon cord having a diameter on the order of one-eighth (⅛) of an inch will also generally have sufficient strength to yield the desired performance, although thicker or thinner diameters of nylon cord could be employed as well. Other cord material candidates include neoprene, cloth fabric sewn into tubular form around a stuffing material, synthetic fiber knit into tubular shape, or any other elastic or non-elastic tubing or cord-type material.

The above description is provided for illustrative purposes only, and variations and modifications to the depicted and described preferred embodiments may become readily apparent to those of ordinary skill in the art without departing from the spirit and scope of the present invention. Accordingly, the scope of the invention is to be determined by having reference to the appended claims.

What is claimed is:

1. A hat retaining device comprising:

a first flexible head loop, said head loop being adapted to be fixed at a size sufficient to be slipped over a head of a hat wearer; and hat holding means coupled to said head loop for coupling said head loop to a hat worn by said hat wearer, said hat holding means being so constructed and arranged to be attached to said hat in a manner permitting said head loop to loosely encircle a neck of said hat wearer near a base of said neck when said head loop is passed over said head and when said hat is positioned on said head.

2. A hat retaining device as recited in claim 1 further comprising floatation means attached to said head loop for maintaining said device near a surface of a body of water upon entry of the device into said body of water.

3. A hat retaining device as recited in claim 1 wherein at least said head loop comprises an elastic material

4. A hat retaining device as recited in claim 3 wherein said elastic material comprises polypropylene.

5. A hat retaining device as recited in claim 1 wherein said hat holding means comprises means for detachably coupling said head loop to said hat.

6. A hat retaining device as defined in claim 5 wherein said coupling means comprises clip means for releasably grasping said hat, said clip means being connected to a first end of a tether, and wherein a second end of said tether is connected to said first head loop.

7. A heat retaining device as recited in claim 6 further comprising means for releasing pulling forces experienced on said neck of said wearer, said releasing means being constructed to break at a predetermined tensile force lower than a tensile force of the remainder of the hat retaining device, wherein said releasing means comprises said tether, and wherein a material comprising said tether is selected to be weaker in tension than said head loop.

8. A hat retaining device as defined in claim 5 wherein said hat holding means comprises a hat loop coupled to said first head loop, said hat loop being of a predetermined size sufficient to permit said head loop to be threaded therethrough.

9. A hat retaining device as defined in claim 8 wherein said hat loop is attached directly adjacent to said head loop.

10. A hat retaining device as defined in claim 9 wherein said first head loop and said hat loop are formed from a single length of a predetermined cord material and at least one clamp means for clamping predetermined sections of said cord material to form said first and second loops.

11. A hat retaining device as defined in claim 8 wherein a tether having a predetermined length extends between said hat loop and said head loop, said tether being attached at one end to said hat loop said tether being attached at an opposite end to said first head loop.

12. A hat retaining device as defined in claim 11 wherein said first head loop, said hat loop, and said tether are formed from a single length of a predetermined cord material and at least two clamp means for clamping predetermined sections of said cord material to form said first and second loops and said tether.

13. A hat retaining device as recited in claim 8 further comprising a means for releasing pulling forces experienced on said neck of said wearer, said releasing means being constructed to break at a predetermined tensile force lower than a tensile force of the remainder of the hat retaining device.

14. A hat retaining device as recited in claim 13 wherein said pulling force releasing means comprises said hat loop, wherein a material comprising said hat loop is selected to be weaker in tension than said head loop.

15. A retaining device for coupling a hat or other headwear having an exposed band extending across a rear portion thereof to a body of a person wearing said hat or other headwear comprising:

a first flexible head loop, said head loop being of a size sufficient to be slipped over a head of said person; and means for forming a band retaining loop, said band retaining loop being coupled to said head loop and adapted to wrap around said exposed band of said hat to connect said hat or other headwear to said first head loop.

16. A retaining device as defined in claim 15 wherein said loop forming means comprises a hat loop, and said hat loop comprises said band retaining loop.

17. A retaining device as defined in claim 15 wherein said loop forming means comprises a hat loop connected to said first head loop, and wherein said band retaining loop is formed by threading said head loop through said hat loop.

18. A retaining device as defined in claim 17 wherein said hat loop is attached directly adjacent to said first head loop.

19. A retaining device as defined in claim 17 wherein said hat loop is fixedly attached to a first end of a tether, and a second end of said tether is attached to said first head loop.

20. A headwear system comprising:

a hat adapted to be worn on a head of a wearer; and a hat retaining device, said hat retaining device further comprising a first head loop, said head loop being of a size sufficient to be slipped over said head, and hat holding means coupled to said head loop for coupling said hat to siad first head loop, said hat holding means being so constructed and arranged that said first head loop will loosely encircle a neck of said wearer near a base of said neck when said first head loop is passed over said head and when said hat is positioned on said head.

21. A headwear system as defined in claim 20 wherein said hat has an exposed band extending around a portion of a back of said hat, and wherein said hat holding means comprises means for forming a band retaining loop to surround said band of said hat.

22. A headwear system as defined in claim 21 wherein said loop forming means comprises a hat loop connected to said first head loop, and wherein said band retaining loop is formed by threading said head loop through said hat loop.

23. A headwear system as defined in claim 20 wherein said hat holding means comprises means for permanently attaching said hat retaining device to said hat.

24. A headwear system as defined in claim 23 wherein said hat holding means comprises a tether, said tether being connected at a first end to said head loop, said tether being connected at a second end to said hat.

* * * * *